US011332936B1

(12) United States Patent
Staton

(10) Patent No.: US 11,332,936 B1
(45) Date of Patent: May 17, 2022

(54) REBAR SUPPORT CHAIR

(71) Applicant: Newtonoid Technologies, L.L.C., Liberty, MO (US)

(72) Inventor: Fielding B. Staton, Liberty, MO (US)

(73) Assignee: Newtonoid Technologies, L.L.C., Liberty, MO (US)

( * ) Notice: Subject to any disclaimer, the term of this patent is extended or adjusted under 35 U.S.C. 154(b) by 0 days.

(21) Appl. No.: 17/096,744

(22) Filed: Nov. 12, 2020

Related U.S. Application Data

(60) Provisional application No. 62/934,333, filed on Nov. 12, 2019.

(51) Int. Cl.
*E04C 5/20* (2006.01)

(52) U.S. Cl.
CPC ..... *E04C 5/20* (2013.01)

(58) Field of Classification Search
CPC . E04C 5/20; E04C 5/166; E04C 5/168; E04C 5/201; E04B 1/98; F03G 7/08
See application file for complete search history.

(56) References Cited

U.S. PATENT DOCUMENTS 1,070,921 A * 8/1913 Saltiel ..... E04C 5/168 52/686
2,950,576 A * 8/1960 Rubenstein ..... E04B 1/383 52/223.13
6,178,716 B1 * 1/2001 Chen ..... E04C 5/168 404/135
7,432,607 B2 * 10/2008 Kim ..... F03G 7/08 290/1 R
8,899,562 B1 * 12/2014 Staton ..... G08B 21/18 267/140.13
10,896,774 B2 * 1/2021 Stilwell ..... H01B 17/14
2004/0206030 A1 * 10/2004 Juedes ..... E04C 5/167 52/384

(Continued)

FOREIGN PATENT DOCUMENTS

CA 1270661 A * 6/1990 ..... E04C 5/20
CN 101886684 A 11/2010

(Continued)

*Primary Examiner* — Christine T Cajilig
(74) *Attorney, Agent, or Firm* — Avek IP, LLC

(57) ABSTRACT

A rebar support chair has a housing with first and second opposed boundary walls spaced apart from one another and defining a cavity therebetween, an attachment portion having a seat for supporting rebar, a dampening member, and a force dispersion member inside the cavity. The attachment portion transfers forces between the rebar and housing. The force dispersion member moves in response to vibration of the attachment portion, and movement of the force dispersion member corresponds with compression and decompression of the dampening member. Another rebar support chair has a housing defining a cavity, an attachment portion for supporting rebar, a dampening member, and a force dispersion member in the cavity. The attachment portion transfers forces between the rebar and housing. The force dispersion member moves from a rest position in response to vibration of the attachment portion, and the dampening member biases the force dispersion member toward the rest position.

21 Claims, 7 Drawing Sheets

(56) References Cited

U.S. PATENT DOCUMENTS

| | | | | |
|---|---|---|---|---|
| 2005/0039455 | A1* | 2/2005 | Borst | F03G 7/08 60/721 |
| 2010/0295322 | A1* | 11/2010 | Brezet | F03G 5/06 290/1 A |
| 2011/0291526 | A1* | 12/2011 | Abramovich | F03G 7/08 310/339 |
| 2020/0217306 | A1* | 7/2020 | Matthews | E01F 9/571 |

FOREIGN PATENT DOCUMENTS

| | | | | |
|---|---|---|---|---|
| CN | 204088085 | U | 1/2015 | |
| CN | 204628819 | U | 9/2015 | |
| KR | 20070099125 | A | 10/2007 | |
| KR | 100945398 | B1 * | 3/2010 | F03G 7/08 |
| KR | 20190056678 | A | 5/2019 | |
| WO | WO-2008029962 | A1 * | 3/2008 | E04B 1/4121 |
| WO | 2016004465 | A1 | 1/2016 | |
| WO | 2016148428 | A1 | 9/2016 | |

* cited by examiner

REBAR SUPPORT CHAIR

RELATED APPLICATIONS

This application claims priority to U.S. Pat. Application 62/934,333 filed Nov. 12, 2019, the contents of which are incorporated herein by reference in their entirety.

FIELD OF INVENTION

The current invention generally relates to reinforced concrete construction. More specifically, the disclosure relates to vibration dampening rebar support chairs and system for reinforced concrete construction.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

According to an embodiment of the disclosure, a rebar support chair has a housing with first and second opposed boundary walls spaced apart from one another and defining a cavity therebetween, an attachment portion having a seat for supporting rebar, a dampening member, and a force dispersion member inside the cavity. The attachment portion transfers forces between the rebar and the housing. The force dispersion member moves in response to vibration of the attachment portion, and movement of the force dispersion member corresponds with compression and decompression of the dampening member.

According to another embodiment of the disclosure, a rebar support chair has a housing defining a cavity, an attachment portion having a seat for supporting rebar, a dampening member, and a force dispersion member in the cavity. The attachment portion transfers forces between the rebar and the housing. The force dispersion member moves from a rest position in response to vibration of the attachment portion, and the dampening member biases the force dispersion member toward the rest position.

DETAILED DESCRIPTION

Figure 1:
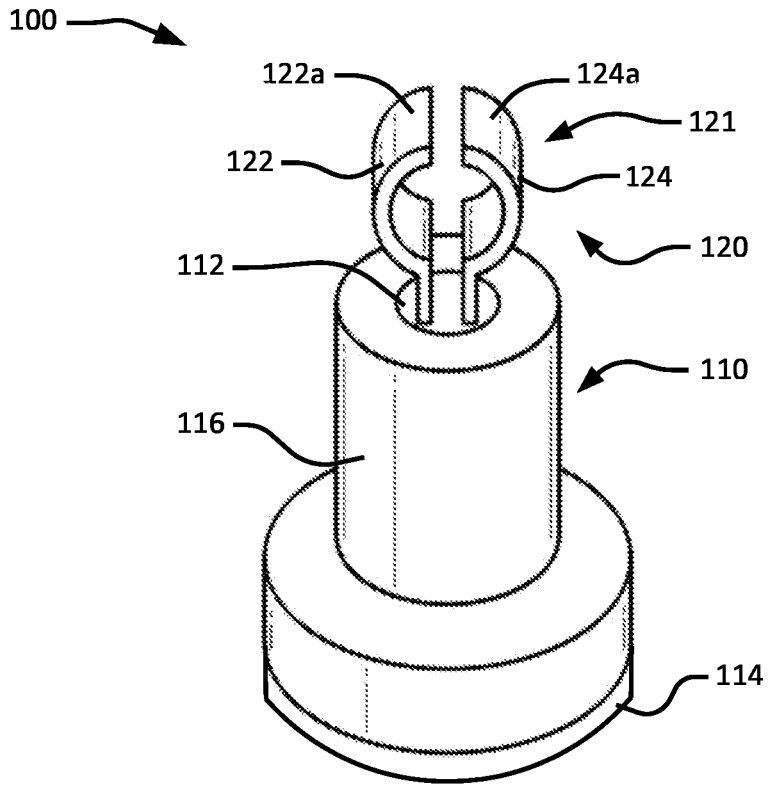
FIG. 1 is a perspective view of a vibration dampening rebar support chair according to an embodiment of the disclosure.
Figure 2:
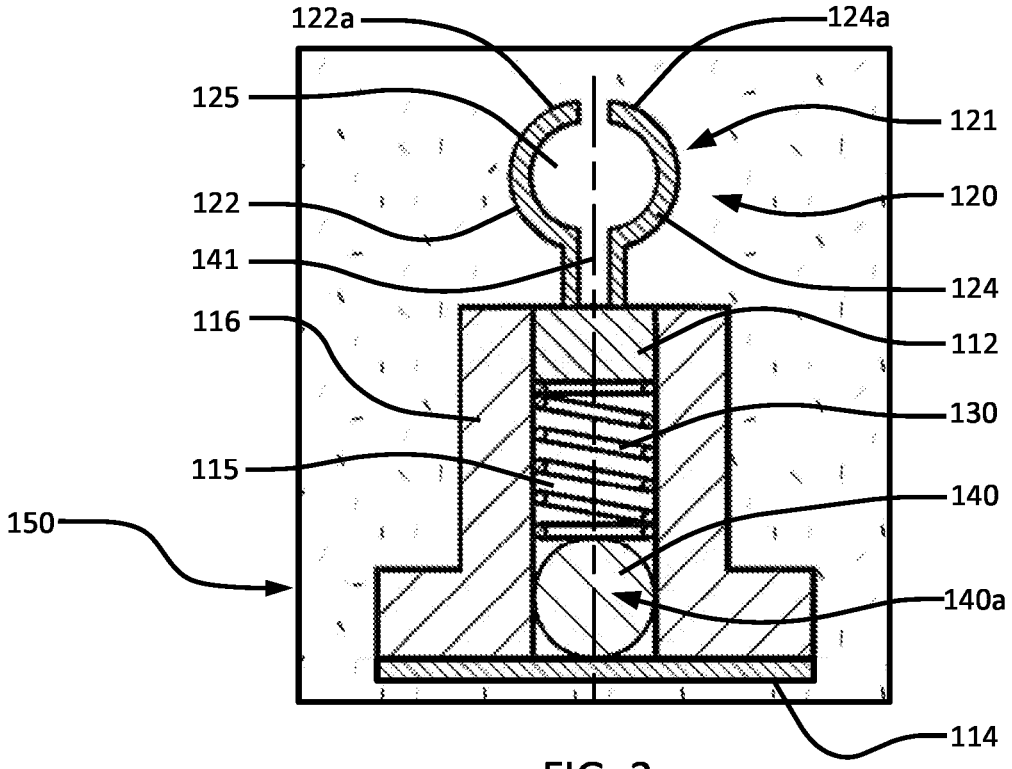
FIG. 2 is a cross section view of the vibration dampening rebar support chair of FIG. 1, taken along a longitudinal center plane.

FIGS. 1 and 2 show a vibration dampening rebar support chair according to an embodiment 100 of the current disclosure. The rebar support chair 100 has a housing 110, an attachment portion 120, a dampening member 130, and a force dispersion member 140. The rebar support chair 100 is configured to be placed within concrete 150 and may be placed at any stage of pouring. For example, the rebar support chair 100 may be positioned against or adjacent a foundation prior to pouring or may be placed from the surface of the poured concrete 150 while the concrete 150 is still wet.

The housing 110 has first and second opposed boundary walls 112, 114 that are spaced apart from one another and define a cavity 115 therebetween. The boundary walls 112, 114 may be formed with or coupled to at least one sidewall 116, and in the embodiment 100 the first boundary wall 112 is shown coupled inside the sidewall 116 while the second boundary wall 114 is shown coupled outside the sidewall 116. Regardless of whether the boundary walls 112, 114 are formed with or coupled to the sidewall 116, it may be particularly important that the cavity 115 is sufficiently encased such that concrete 150 is not able to enter into the cavity 115. The at least one sidewall 116 and/or the second boundary wall 114 may be flared to provide stability when the housing 110 is used in the orientation shown in FIGS. 1 and 2. The boundary walls 112, 114 and the sidewall 116 may be constructed of plastic, metal, composite, and/or any other appropriate materials.

The attachment portion 120 has a seat 121 configured to support rebar, and the attachment portion 120 transfers forces between the rebar and the housing 110. In some embodiment, the attachment portion 120 is formed with the housing 110 such that concrete 150 is not allowed to enter the cavity 115, and in other embodiments, the attachment portion 120 is coupled to the housing 110 such that concrete 150 is not allowed to enter the cavity 115. The seat 121 includes two arms 122, 124 that collectively define a sufficient perimeter for seating rebar in a passage 125. While it may be particularly desirable for the arms 122, 124 to have distal ends 122*a*, 124*a* that are separable to allow rebar to enter into the passage 125, separable ends 122*a*, 124*a* may not be required since rebar may alternately, for example, be passed axially into the passage 125. In some embodiments, the seat 121 may sufficiently grasp rebar such that no additional coupling is required. But in other embodiments, it may be desirable to use a tie, clip, crimp, weld, or other appropriate fastener to secure rebar to the seat 121 with the rebar being located in the passage 125. While the passage 125 is shown to be a generally circular and cylindrical in shape, other shapes may alternately be used (e.g., rectangular, triangular, polygonal, etc.) and the shape of the passage 125 need not be constant from one end of the passage 125 to another end of the passage 125 (e.g., barbs, nubs, teeth, etc. may be located in the passage 125 to further grip rebar).

The dampening member 130 biases the force dispersion member 140 toward a rest position 140*a* in the cavity 115, and may for example be a mechanical spring (as shown in FIG. 2), a gas spring, a pneumatic spring, or a magnetic spring. It may be desirable for the dampening member 130 to be positionable against the first boundary wall 112 and/or the second boundary wall 114, and it may be even more desirable in some embodiments for the dampening member 130 to be operatively coupled to the first boundary wall 112 and/or the second boundary wall 114.

The force dispersion member 140 may be any appropriate mass positionable and movable as described. If a magnetic spring is used for the dampening member 130, it may be particularly desirable to use a ferrous or otherwise magnetic material for the force dispersion member 140—though a magnetic element may be placed atop, coupled to, or otherwise interact with the force dispersion member 140 as part of such a magnetic spring. Other appropriate materials may include other metals, ceramics, glass, natural or synthetic rubbers, and combinations of such materials. The shape of the force dispersion member 140 may be, for example, spherical, cubic, or conical, and the weight of the force dispersion member 140 may be selected as desired to affect dampening characteristics of the rebar support chair 100.

In use, the force dispersion member 140 moves in the cavity 115 (e.g., along axis 141) from the rest position 140*a* in response to vibration of the attachment portion 120, which is caused by vibration of the attached rebar. The dampening member 130 in turn biases the force dispersion member 140 toward the rest position 140*a*. Especially if the dampening member 130 is a mechanical spring, movement of the force dispersion member 140 may correspond with compression and decompression of the dampening member 130. But regardless of the specific type of dampening member 130 that is used, the dampening member 130 and the force dispersion member 140 may be tuned (e.g., selected or adjusted to jointly have properties) such that the dampening member 130 and the force dispersion member 140 react to a specific frequency band of vibrations. To adjust the dampening member 130, the boundary wall 112 and/or the boundary wall 114 may for example be adjustable (e.g., by being coupled to the at least one sidewall 116 in a threaded manner that allows for relative movement between the boundary wall and the at least one sidewall 116) to change the location or amount of force on the dampening member 130 when the force dispersion member 140 is at the rest position 140*a*. It may be particularly beneficial to tune the components to protect against resonance frequencies, though other frequency bands may also be targeted. Movement of the force dispersion member 140 inside the cavity 115 dampens the vibrational forces received from the rebar, and may reduce cracking in or otherwise lengthen the useful lifespan of the concrete 150 that encases the rebar and the rebar support chair 100. And while the attachment portion 120 may be located at various locations relative to the housing 110, configuring the attachment portion 120 such that rebar supported by the seat 121 passes through the axis 141 may be desirable in transferring vibrational forces from the rebar to the attachment portion 120 and ultimately to the force dispersion member 140.

Figure 3:
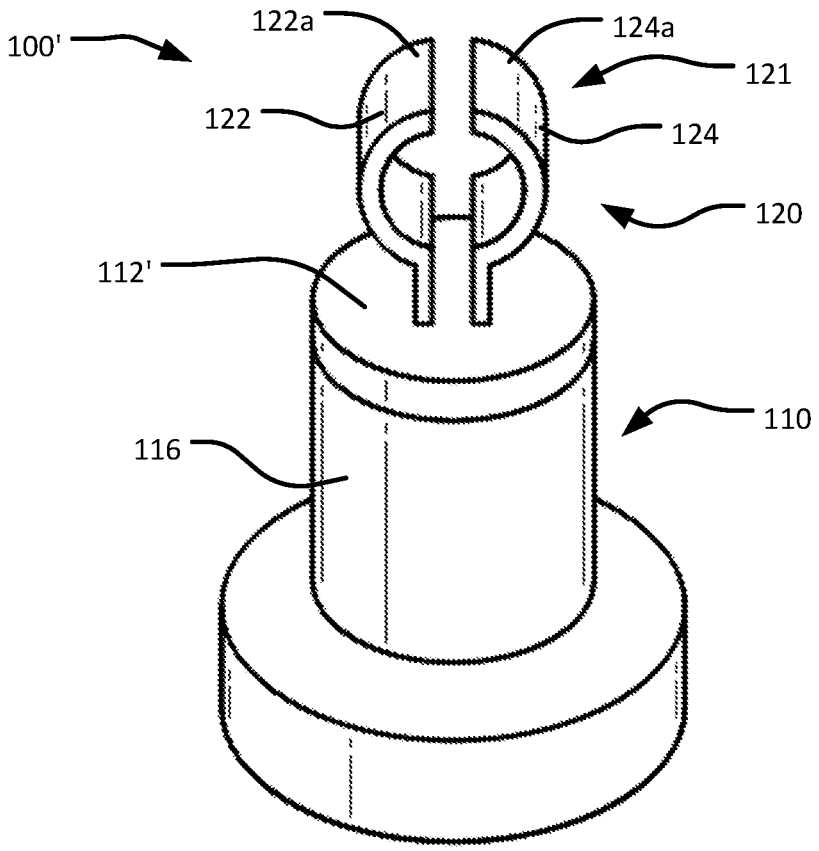
FIG. 3 is a perspective view of a vibration dampening rebar support chair according to another embodiment of the disclosure.
Figure 4:
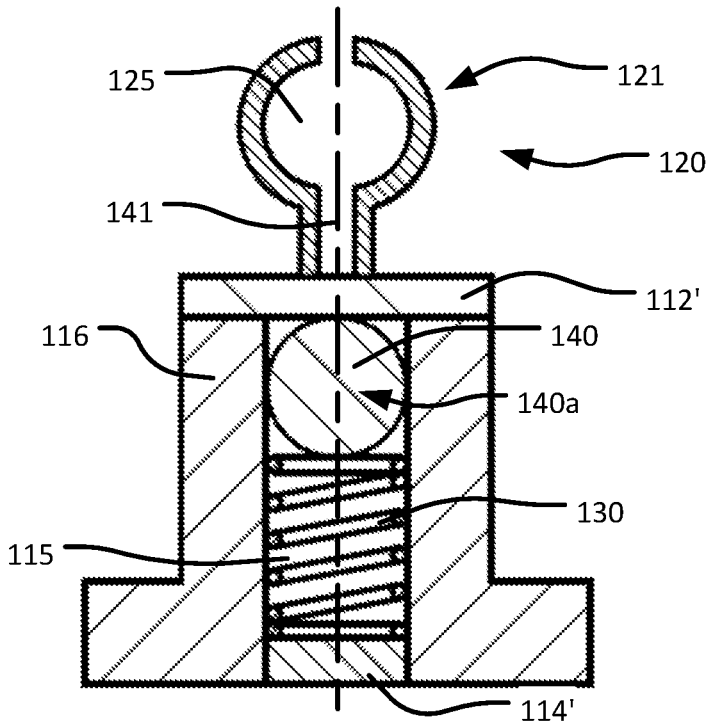
FIG. 4 is a cross section view of the vibration dampening rebar support chair of FIG. 3.

FIGS. 3 and 4 show a vibration dampening rebar support chair 100' that is substantially similar to the vibration dampening rebar support chair 100, with two main differences. First, while the first boundary wall 112 is shown coupled inside the at least one sidewall 116 and the second boundary wall 114 is shown coupled outside the at least one sidewall 116 in the embodiment 100, the first boundary wall 112' is shown coupled outside the at least one sidewall 116 and the second boundary wall 114' is shown coupled inside the at least one sidewall 116 in the embodiment 100'. In other embodiments, the boundary walls 112, 114 may both be coupled inside or outside the at least one sidewall 116 and at least one of the boundary walls 112, 114 may be formed with the at least one sidewall 116.

Second, the dampening member 130 is shown adjacent the boundary wall 112 such that the dampening member 130 is between the force dispersion member 140 and the attachment member 120 in FIG. 2, while the dampening member 130 is shown adjacent the boundary wall 114 such that the force dispersion member 140 is between the dampening member 130 and the attachment member 120 in FIG. 4. Depending on the specific environment of the concrete 150 encasing the rebar support chairs, one arrangement or the other may be desirable; and this arrangement may further be considered part of tuning the components to target specific vibrational frequency bands as discussed above. The arrangement of the dampening member 130 and the force dispersion member 140 does not have to be dependent on whether the boundary walls 112, 114 are coupled inside or outside the at least one sidewall 116.

Figure 5:
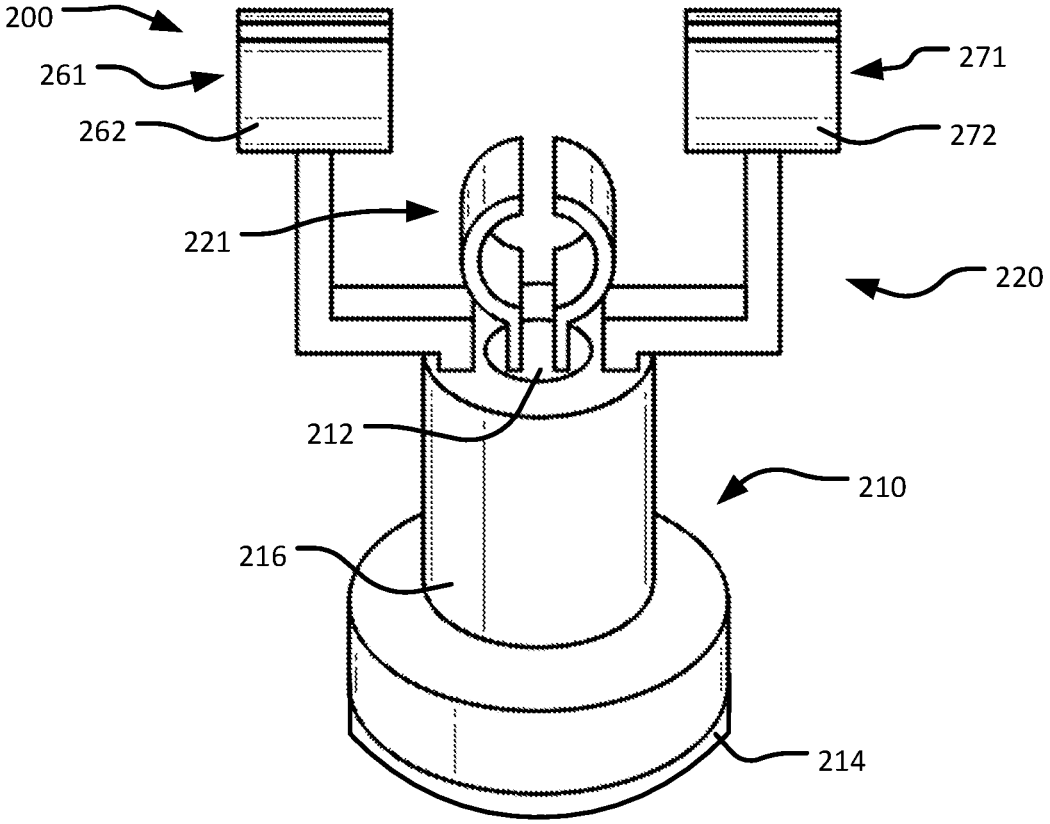
FIG. 5 is a perspective view of a vibration dampening rebar support chair according to still another an embodiment of the disclosure.
Figure 6:
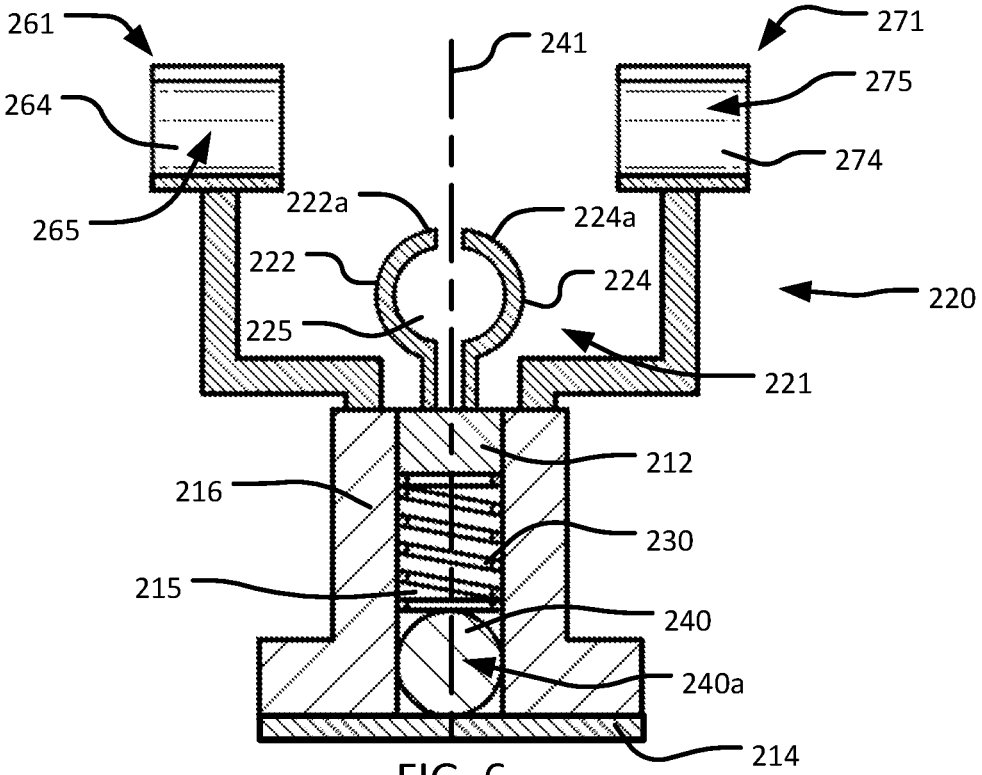
FIG. 6 is a cross section view of the vibration dampening rebar support chair of FIG. 5, taken along a longitudinal center plane.

FIGS. 5 and 6 show another vibration dampening rebar support chair 200 that is substantially similar to the embodiment 100, except as specifically noted and/or shown, or as would be inherent. Further, those skilled in the art will appreciate that the embodiment 100 (and thus the embodiment 200) may be modified in various ways, such as through incorporating all or part of any of the various described embodiments, for example. For uniformity and brevity, reference numbers between 200 and 299 may be used to indicate parts corresponding to those discussed above numbered between 100 and 199 (e.g., housing 210 corresponds generally to the housing 110, boundary wall 212 corresponds generally to the 112, boundary wall 214 corresponds generally to the boundary wall 114, cavity 215 corresponds generally to the cavity 115, sidewall(s) 216 corresponds generally to the sidewall(s) 116, attachment portion 220 corresponds generally to the attachment portion 120, seat 221 corresponds generally to the seat 121, arm 222 corresponds generally to the arm 122, arm distal end 222*a* corresponds generally to the distal end 122*a*, arm 224 corresponds generally to the arm 124, arm distal end 224*a* corresponds generally to the arm distal end 124*a*, dampening member 230 corresponds generally to the dampening member 130, force dispersion member 240 corresponds generally to the force dispersion member 140, rest position 240*a* corresponds generally to the rest position 140*a*, and axis 241 corresponds generally to the axis 141), though with any noted or shown deviations.

In embodiment 200, the attachment portion 220 has additional seats 261, 271 configured to support rebar and transfer vibrational forces from the supported rebar to the housing 210. As with the seat 221, the seats 261, 271 may be formed with or attached to the housing 210 such that concrete is not allowed in the cavity 215. And as with the seat 221, each of the seats 261, 271 may include two arms 262, 264, 272, 274 that collectively define a sufficient perimeter for seating rebar in a passage 265, 275. In short, the attachment portion 220 allows additional vibrations from different rebar to be dampened by the dampening member 230 and the force dispersion member 240. While it may be desirable for the seats 261, 271 to support rebar at different heights from rebar supported by the seat 221 and in nonparallel alignment with rebar supported by the seat 221 (as shown in FIGS. 5 and 6), other embodiments may be configured to support rebar at the same height and/or in parallel alignment.

Figure 7:
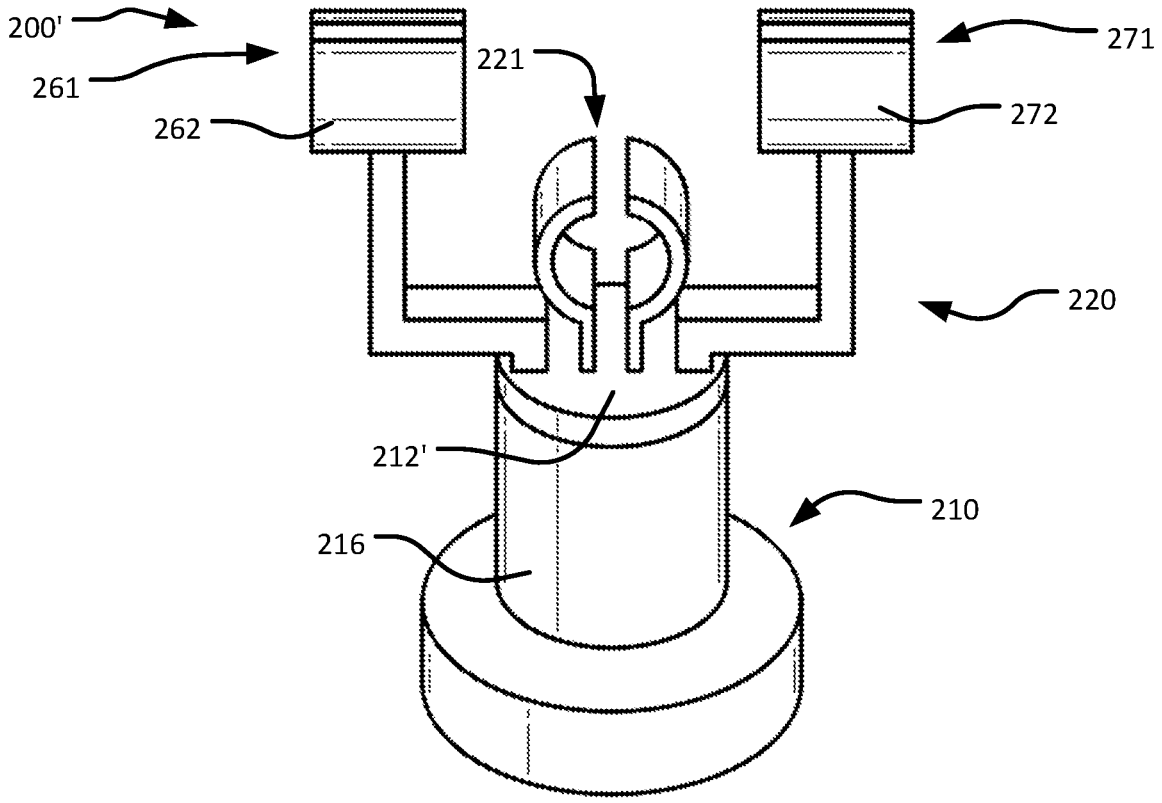
FIG. 7 is a perspective view of a vibration dampening rebar support chair according to yet another embodiment of the disclosure.
Figure 8:
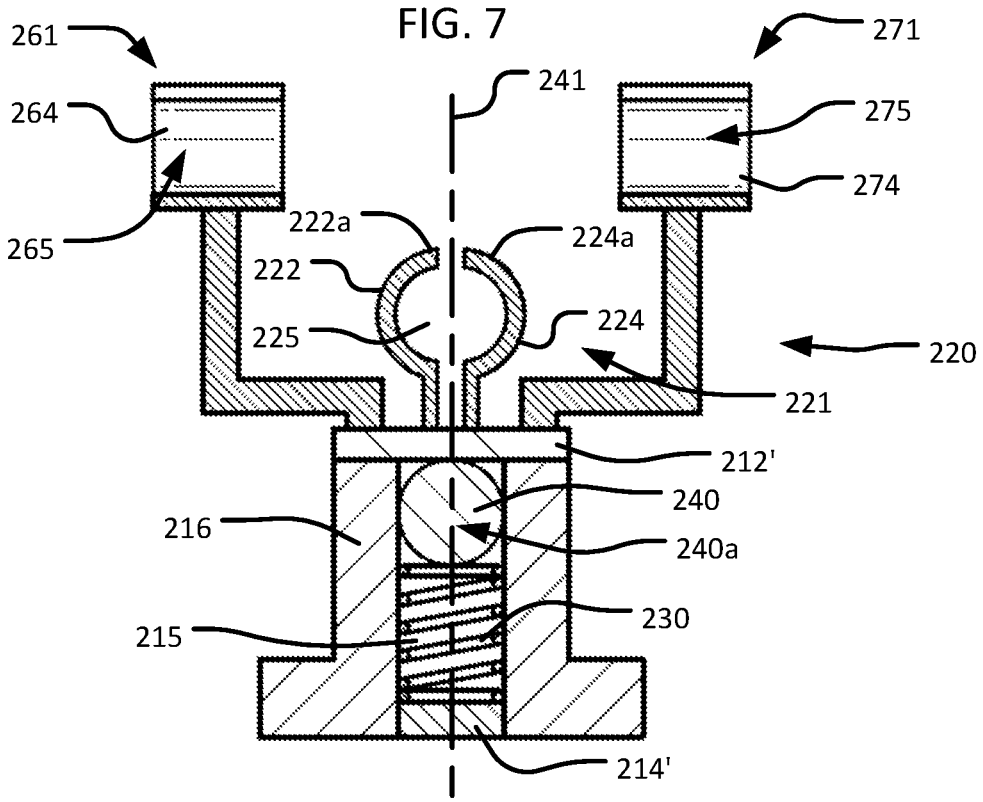
FIG. 8 is a cross section view of the vibration dampening rebar support chair of FIG. 7.

FIGS. 7 and 8 illustrate through embodiment 200' that (as discussed above regarding FIGS. 3 and 4) the boundary walls 212', 214' may each be coupled inside or outside the at least one sidewall 216. And, as noted above, at least one of the boundary walls 212', 214' may be formed with the at least one sidewall 216.

Figure 9:
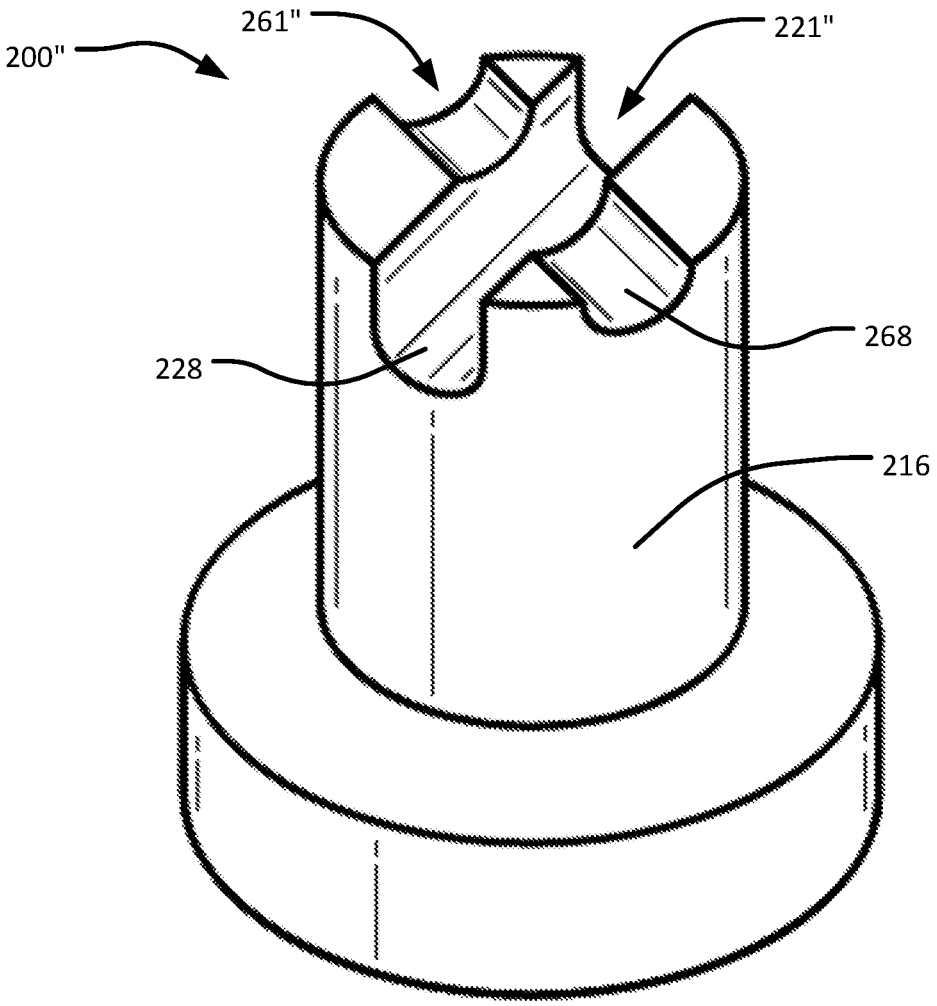
FIG. 9 is a perspective view of a vibration dampening rebar support chair according to still yet another embodiment of the disclosure.

FIG. 9 illustrates through embodiment 200" the boundary wall 212" being formed with the at least one sidewall 216. In addition, the attachment portion 220" in FIG. 9 has a first notch 228 defining the seat 221" and a second notch 268 (which is separated into two pieces) defining the seat 261". Rebar may be tied to or otherwise fastened to the rebar support chair 220" when placed in the seats 221", 261", and the rebar support chair 220" may operate in the same basic manner as the embodiments described above.

Figure 10:
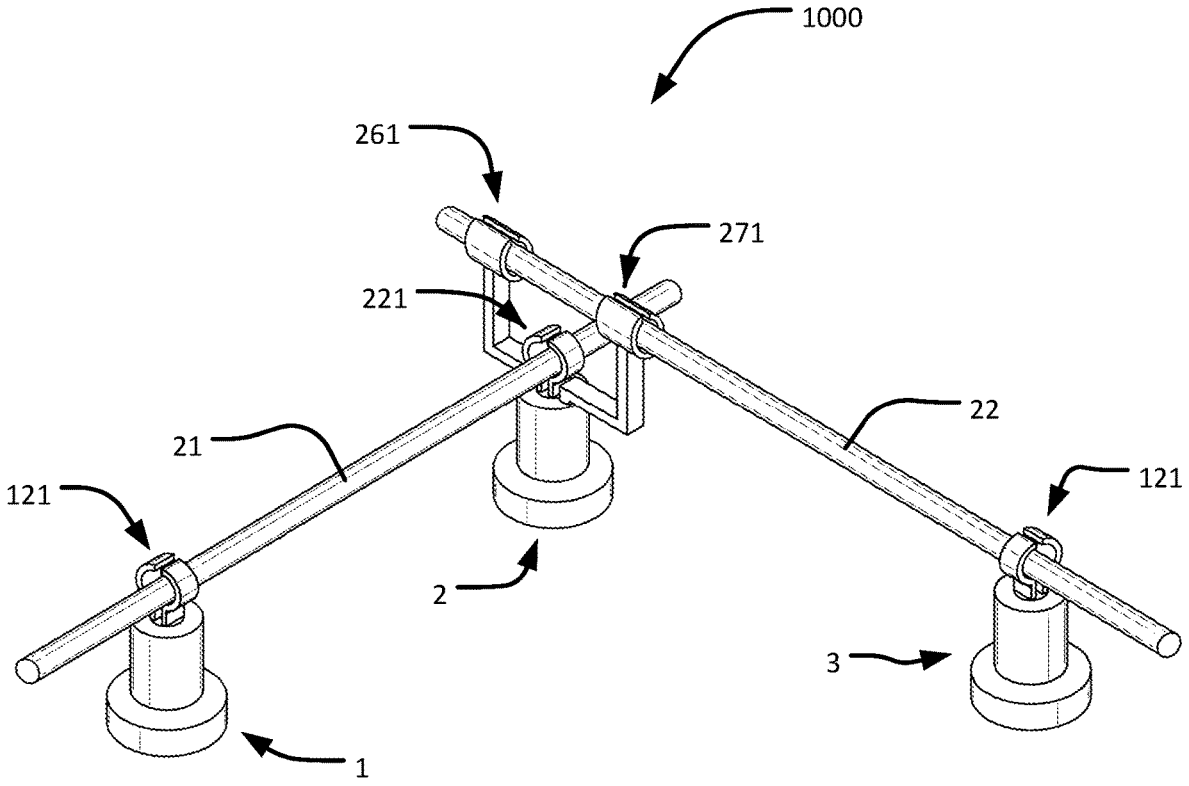
FIG. 10 is a perspective view of a system using the vibration dampening rebar support chairs of FIGS. 3 and 7.

FIG. 10 shows a system 1000 of vibration dampening chairs secured to a multiple pieces of rebar. While rebar dampening chairs 100', 200' described above are illustrated, any of the described rebar dampening chairs or their variations may instead be used. A first piece of rebar 21 is coupled to one of the rebar dampening chairs 100' labeled 1 (i.e., at seat 121) and to the rebar dampening chair 200' labeled 2 (i.e., at seat 221), and a second piece of rebar 22 is coupled to the other of the rebar dampening chairs 100' labeled 3 (i.e., at seat 121) and to the rebar dampening chair 200' labeled 2 (i.e., at seats 261, 271).

The system 1000 is thus configured so that the movement of the first piece of rebar 21 may be dampened by the first chair 1, the second chair 2, and third chair 3. More particularly, the movement of the first piece of rebar 21 may transfer energy into the first chair 1 and the second chair 2, and the second chair 2 may then transfer some of the movement from the first piece of rebar 21 into the second piece of rebar 22. The third chair 3 may then receive energy from the second piece of rebar 22. And each of the vibration dampening chairs 1, 2, 3 may respond as set forth above to dampen the vibrational energy that it receives. The system 1000 is merely an example, and the concept explained can be transferred to cover any number of the disclosed chairs with rebar. Further, the system 1000 may even be used to cover a large area, which may contain varying heights or irregular shapes. The adaptability of the vibration dampening chairs to be placed at different heights to one another as well as hold different pieces of rebar at different angles and heights may allow for the system 1000 to be easily adapted to and provide vibration dampening for projects outside the scope of basic concrete structures, such as staircases, sculptures, or elevator shafts.

Figure 11:
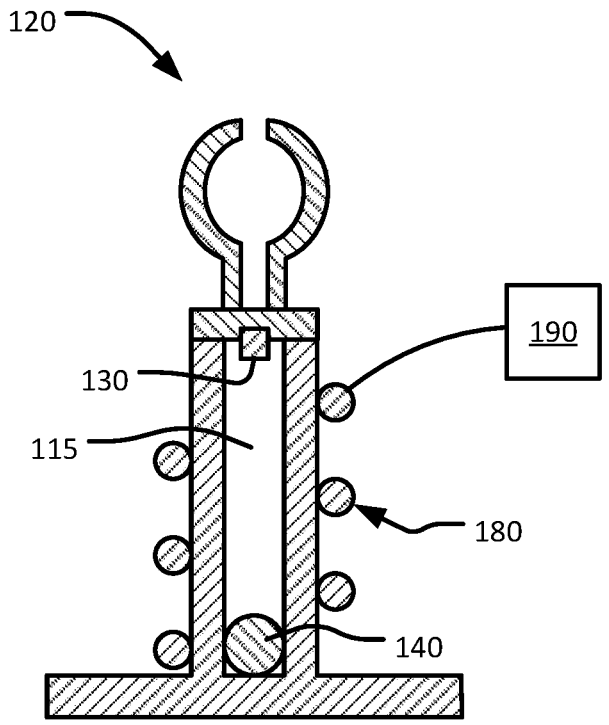
FIG. 11 shows additional components that may be incorporated into the various embodiments of the disclosure.

FIG. 11 shows additional components that may be used to generate electricity using the rebar support chairs as vibrational energy is dampened as discussed above. Reference numbers used regarding FIG. 1 are used for simplicity. In FIG. 11, the dampening member 130 is a magnetic spring (though other types of dampening members 130 may alternately be used) and the force dispersion member 140 is magnetic. A vibration powered generator (e.g., an electromagnetic coil) 180 is positioned around the cavity 115. When the magnetic force dispersion member 140 moves in relation to the coil 180, this changes the magnetic flux passing through the coil 180 and thus induces flow of an electric current that is then stored in battery 190 (which may be positioned on, adjacent, or remote from the housing 110). The battery 190 may power other components in the rebar support chairs (e.g., transmitters and other electrical devices) or may be used to power other devices altogether. In some embodiments, a battery 190 is electrically connected to the vibration powered generator 180 of multiple rebar support chairs.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Not all steps listed in the various figures need be carried out in the specific order described.

The invention claimed is:

1. A rebar support chair configured to be situated in concrete, the rebar support chair comprising:

a housing having first and second opposed boundary walls spaced apart from one another and defining a cavity therebetween;

an attachment portion having a seat for supporting rebar, the attachment portion transferring forces between the rebar and the housing;

a dampening member configured to compress and decompress, the dampening member being positionable against an item selected from the group consisting of the first boundary wall and the second boundary wall; and a force dispersion member inside the cavity;

wherein:

the attachment portion is configured to hold a plurality of rebar pieces in nonparallel alignment;

the force dispersion member moves in response to vibration of the attachment portion; and movement of the force dispersion member corresponds with compression and decompression of the dampening member.

2. The rebar support chair of claim 1, wherein:

the force dispersion member is movable along an axis; and the attachment portion is configured such that rebar supported by the seat passes through the axis.

3. The rebar support chair of claim 1, wherein the attachment portion is configured to hold the plurality of rebar pieces at different heights from one another.

4. The rebar support chair of claim 1, wherein:

the attachment portion has a second seat; and the first seat and the second seat are configured to hold the plurality of rebar pieces at different heights from one another.

5. A rebar support chair configured to be situated in concrete, the rebar support chair comprising:

a housing having first and second opposed boundary walls spaced apart from one another and defining a cavity therebetween;

an attachment portion having a seat for supporting rebar, the attachment portion transferring forces between the rebar and the housing;

a dampening member configured to compress and decompress, the dampening member being positionable against an item selected from the group consisting of the first boundary wall and the second boundary wall; and a force dispersion member inside the cavity;

wherein:

the attachment portion comprises a plurality of notches;

the force dispersion member moves in response to vibration of the attachment portion; and movement of the force dispersion member corresponds with compression and decompression of the dampening member.

6. A rebar support chair configured to be situated in concrete, the rebar support chair comprising:

a housing having first and second opposed boundary walls spaced apart from one another and defining a cavity therebetween;

an attachment portion having a seat for supporting rebar, the attachment portion transferring forces between the rebar and the housing;

a dampening member configured to compress and decompress, the dampening member being positionable against an item selected from the group consisting of the first boundary wall and the second boundary wall; and a force dispersion member inside the cavity;

wherein:

the seat comprises two arms that collectively define a sufficient perimeter for seating rebar in a passage;

the force dispersion member moves in response to vibration of the attachment portion; and movement of the force dispersion member corresponds with compression and decompression of the dampening member.

7. A rebar support chair configured to be situated in concrete, the rebar support chair comprising:

a housing having first and second opposed boundary walls spaced apart from one another and defining a cavity therebetween;

an attachment portion having a seat for supporting rebar, the attachment portion transferring forces between the rebar and the housing;

a dampening member configured to compress and decompress, the dampening member being positionable against an item selected from the group consisting of the first boundary wall and the second boundary wall;

a force dispersion member inside the cavity; and a vibration powered generator;

wherein:

the force dispersion member moves in response to vibration of the attachment portion; and movement of the force dispersion member corresponds with compression and decompression of the dampening member.

8. The rebar support chair of claim 7, wherein the vibration powered generator is electrically connected to a battery.

9. A rebar support chair configured to be situated in concrete, the rebar support chair comprising:

a housing having first and second opposed boundary walls spaced apart from one another and defining a cavity therebetween;

an attachment portion having a seat for supporting rebar, the attachment portion transferring forces between the rebar and the housing;

a dampening member configured to compress and decompress, the dampening member being positionable against an item selected from the group consisting of the first boundary wall and the second boundary wall; and a force dispersion member inside the cavity;

wherein:

the force dispersion member moves in response to vibration of the attachment portion;

movement of the force dispersion member corresponds with compression and decompression of the dampening member; and the dampening member and the force dispersion member are tuned to a specific frequency band.

10. The rebar support chair of claim 1, wherein the dampening member is operatively coupled to at least one item selected from the group consisting of the first boundary wall and the second boundary wall.

11. A rebar support chair configured to be inside concrete, the rebar support chair comprising:

a housing defining a cavity;

an attachment portion having a seat for supporting rebar, the attachment portion transferring forces between the rebar and the housing;

a dampening member;

a force dispersion member in the cavity; and a vibration powered generator configured to convert movement of the force dispersion member into electricity;

wherein the force dispersion member moves from a rest position in response to vibration of the attachment portion; and wherein the dampening member biases the force dispersion member toward the rest position.

12. The rebar support chair of claim 11, wherein the attachment portion is configured to support a plurality of rebar pieces.

13. The rebar support chair of claim 11, wherein the dampening member is selected from the group consisting of a mechanical spring, a gas spring, a pneumatic spring, and a magnetic spring.

14. The rebar support chair of claim 11, further comprising a battery electrically connected to the vibration powered generator.

15. An electricity generating system, comprising:

at least a first and a second of the rebar support chairs of claim 11; and a battery, the battery being electrically connected to the vibration powered generator of the first rebar support chair and to the vibration powered generator of the second rebar support chair.

16. A section of concrete, comprising:

rebar;

a housing defining a cavity;

an attachment portion extending from the housing, the attachment portion having a seat supporting the rebar, the attachment portion transferring forces between the rebar and the housing;

a force dispersion member in the cavity, the force dispersion member moving from a rest position in response to vibration of the housing and thereafter returning to the rest position; and concrete encasing the housing, the concrete not entering the cavity.

17. The section of concrete of claim 16, further comprising a dampening member biasing the force dispersion member toward the rest position.

18. The rebar support chair of claim 6, wherein:

the force dispersion member is movable along an axis; and the attachment portion is configured such that rebar supported by the seat passes through the axis.

19. The rebar support chair of claim 6, wherein the dampening member and the force dispersion member are tuned to a specific frequency band.

20. The rebar support chair of claim 11, wherein the seat comprises two arms that collectively define a sufficient perimeter for seating rebar in a passage.

21. The rebar support chair of claim 11, wherein:

the force dispersion member is movable along an axis; and the attachment portion is configured such that rebar supported by the seat passes through the axis.

* * * * *